United States Patent [19]

Gates et al.

[11] 4,088,918

[45] May 9, 1978

[54] INCANDESCENT LAMP HAVING EMBEDDED SUPPORT WIRES

[75] Inventors: Paul E. Gates, Danvers; Stephen F. Kimball, Georgetown, both of Mass.

[73] Assignee: GTE Sylvania Incorporated, Danvers, Mass.

[21] Appl. No.: 702,659

[22] Filed: Jul. 6, 1976

[51] Int. Cl.[2] ..... H01K 1/14

[52] U.S. Cl. ..... 313/315; 313/318

[58] Field of Search ..... 313/315, 318

[56] References Cited

U.S. PATENT DOCUMENTS

| | | | |
|---|---|---|---|
| 2,542,326 | 2/1951 | Greiner | 313/315 X |
| 3,617,797 | 11/1971 | Eindhoven et al. | 313/318 |

*Primary Examiner*—Saxfield Chatmon, Jr.

*Attorney, Agent, or Firm*—James Theodosopoulos

[57] ABSTRACT

The support means for a press-sealed single-ended tubular incandescent lamp comprises support wires which are embedded in the press seal and protrude from the edge thereof, substantially orthogonal to the axis of the lamp.

3 Claims, 1 Drawing Figure

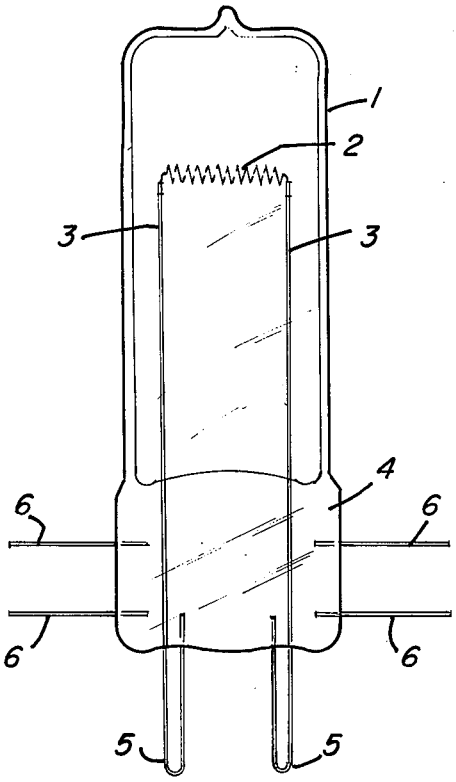
1
2
3
3
4
6
6
6
6
5
5

INCANDESCENT LAMP HAVING EMBEDDED SUPPORT WIRES

THE INVENTION

This invention concerns press-sealed single-ended incandescent lamps. An example of such a lamp is shown in U.S. Pat. No. 3,829,729 the disclosure of which is incorporated herein by reference. Such lamps were generally mounted by means of a bracket, made from sheet metal, secured around the press.

This invention discloses a simpler mount for such lamps, which can be more readily manufactured on high speed sealing machines.

The single FIGURE in the drawing is an elevational view of a lamp in accordance with this invention.

The lamp comprises a tubular glass envelope 1 containing a coiled tungsten filament 2 mounted on lead-in wires 3 which are sealed in, and extend through, press seal 4. If desired, the external portion of each lead-in wire 3 could be curved back on itself, the end secured in press seal 4, to form loop 5.

The support means for the lamp comprises four support wires 6. One end of each support wire 6 is embedded in press seal 4 and the support wires 6 are substantially perpendicular to the axis of envelope 1. In mounting, the lamp would be, say, coaxially positioned within a concave reflector, adjusted to the exact location desired, and then be secured in that position by welding the support wires to the mount structure of the reflector. If desired, support wires 6 could also serve as lead-in conductors by bending each loop 5 to make physical contact with, and establish electrical connection to, proximate support wire 6.

Although the lamp could be made and mounted with only one support wire 6 extending from each longitudinal side of press seal 4, the use of two support wires 6 on each longitudinal side substantially eliminates the torsional forces on the single support wire. The two support wires may be a single wire in the shape of a hairpin.

The coefficient of expansion of the support wires should be compatible with that of the glass. For example, if the glass is an aluminosilicate, such as type 1720, support wires 6 can be made of molybdenum, kovar or rodar.

Support wires 6 are preferably inserted into press seal 4 while it is still soft at the time the press is made. For satisfactory embedment, to prevent cracks, the ends of support wires 6 must not have sharp corners or edges, such as occur after cutting operation. To eliminate, the wires should be deburred or tumbled, prior to embedment.

Also, to improve the bond of the glass to support wire 6, the support wire can be lightly oxidized prior to embedment by, for example, playing a flame thereon. Advantageously, the embedment can be made while support wire 6 is still hot from such a flaming.

We claim:

1. In a single-ended tubular incandescent lamp containing a tungsten filament and having a press seal at one end thereof, the tungsten filament being supported on lead-in wires that are sealed in the press seal, the improvement which comprises two support wires at each side of the press seal, each support wire being embedded in the press seal and extending from the longitudinal edge thereof substantially perpendicular to the envelope axis, the support wires being unconnected to the lead-in wires, the support wires being substantially coplanar with the press seal in order to substantially eliminate torsional forces.

2. The lamp of claim 1 wherein the embedded end of each support wire does not have a sharp edge.

3. The lamp of claim 1 wherein the surface of the embedded portion of each support wire is oxidized.

* * * * *